United States Patent [19]

Okayasu

[11] 4,354,617

[45] Oct. 19, 1982

[54] CIGARETTE FEEDING DEVICE

[76] Inventor: Kunitoshi Okayasu, No. 3,5-chome, Kaiko-cho, Atami-shi, Shizuoka-ken,, Japan

[21] Appl. No.: 179,833

[22] Filed: Aug. 20, 1980

[51] Int. Cl.[3] ..... B65D 83/02

[52] U.S. Cl. ..... 221/147; 221/200

[58] Field of Search ..... 221/143, 147, 200, 202, 221/203

[56] References Cited

U.S. PATENT DOCUMENTS 1,804,580 5/1931 Whitesides ..... 221/200

3,186,590 6/1965 Beha et al. ..... 221/147

FOREIGN PATENT DOCUMENTS 52-886483 of 1977 Japan .

55-7224 of 1978 Japan .

*Primary Examiner*—H. Grant Skaggs

*Attorney, Agent, or Firm*—Armstrong, Nikaido, Marmelstein & Kubovcik

[57] ABSTRACT

A cigarette feeding device consisting of a case wherein a pushing lever is engaged with a rocking lever, return springs are engaged with the rocking end of the above mentioned rocking lever, a rotated by the elongation and contraction of the above mentioned return spring is provided, an opposed gear is engaged with it, a disk having a ratchet wheel fixed to it and rotating in only one direction is attached to the above mentioned opposed gear, a projection is provided on the above mentioned disk and is loosely fitted to a reciprocatable conveying plate, a feeding plate is provided above the above mentioned conveying plate, a bimetal separated by heating is locked to the above mentioned ratchet wheel, a heater and a delivery port are provided as opposed to each other in the tangential direction to the above mentioned rotary chuck and a switch passing electricity to the above mentioned bimetal and heater is arranged so as to be able to contact the above mentioned rocking lever.

The rotary chuck is formed of an elastic material. The gear and opposed gear are equal in the number of teeth. The pushing lever makes one rotation with the maximum pressing. The feeding plate can be rocked. The return spring is a constant load closely wound spiral spring.

9 Claims, 12 Drawing Figures

CIGARETTE FEEDING DEVICE

TECHNICAL FIELD

This invention relates to a device for feeding out cigarettes contained in a case one by one as automatically ignited as required.

BACKGROUND TECHNIQUE

In a conventional car lighter, a cigarette held in a mouth is ignited as brought near to the lighter and therefore this operation has been dangerous to the driver. If an ignited cigarette can be fed to the driver, it will greatly contribute to the safe driving.

The feeding device mentioned in the Japanese patent publication No. 12475/1977 (published on Apr. 7, 1977) filed by the present applicant relates to a device for feeding comparatively soft bars one by one as ignited or roasted. Further, the cigarette feeding device mentioned in the Japanese patent publication No. 7224/1980 (published on Feb. 23, 1980) is to feed ignited cigarettes.

The present invention is designed a further improvement of the above mentioned devices.

Therefore, the present invention has it as an object to provide a device for automatically feeding a ciagarette as ready to be smoked as it is by a very simple operation.

Another object of the present invention is to positively ignite and feed various kinds of cigarettes irrespective of the size and length.

DISCLOSURE OF THE INVENTION

The cigarette feeding device of the present invention is characterized in that, within a case, a pushing lever projected out at one end is engaged with a rocking lever, return springs are engaged with the rocking end of the rocking lever, a rotary chuck is fixed, a gear rotated by the elongation and contraction of the above mentioned return spring is provided, a gear engaging with the above mentioned gear is opposed to it, a disk having a ratchet wheel fixed to it and rotating in only one direction is attached to the above mentioned opposed gear, a projection is provided on the disk and is loosely fitted to a reciprocatable conveying plate, a feeding plate is provided above the conveying plate, a bimetal separated by heating is locked to the above mentioned ratchet wheel, a heater and a delivery port are provided on the wall surfaces of the case so as to be opposed to each other in the tangential direction to the above mentioned rotary chuck and a switch passing electricity to the bimetal and heater is arranged so as to be able to contact the above mentioned rocking lever.

BRIEF EXPLANATION OF THE DRAWINGS

The drawings show an embodiment of the present invention.

BEST FORM TO WORK THE INVENTION

Figure 1:
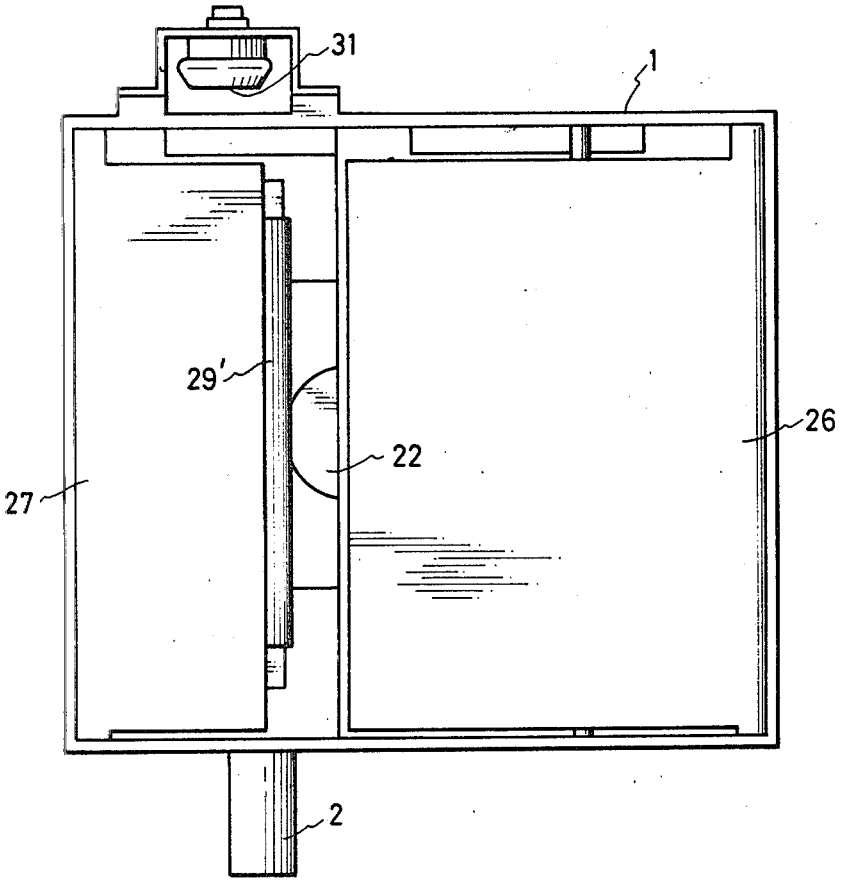
FIG. 1 is a plan view.
Figure 2:
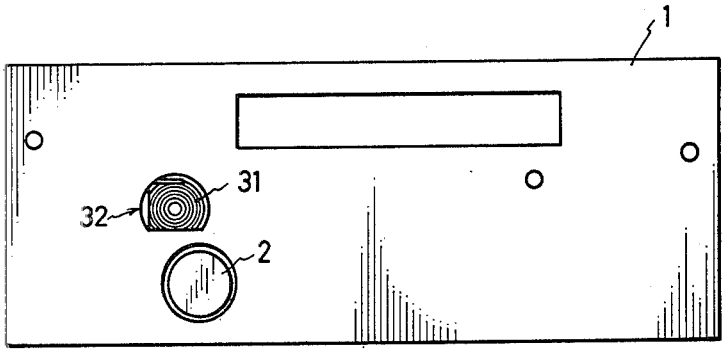
FIG. 2 is an elevation.
Figure 3:
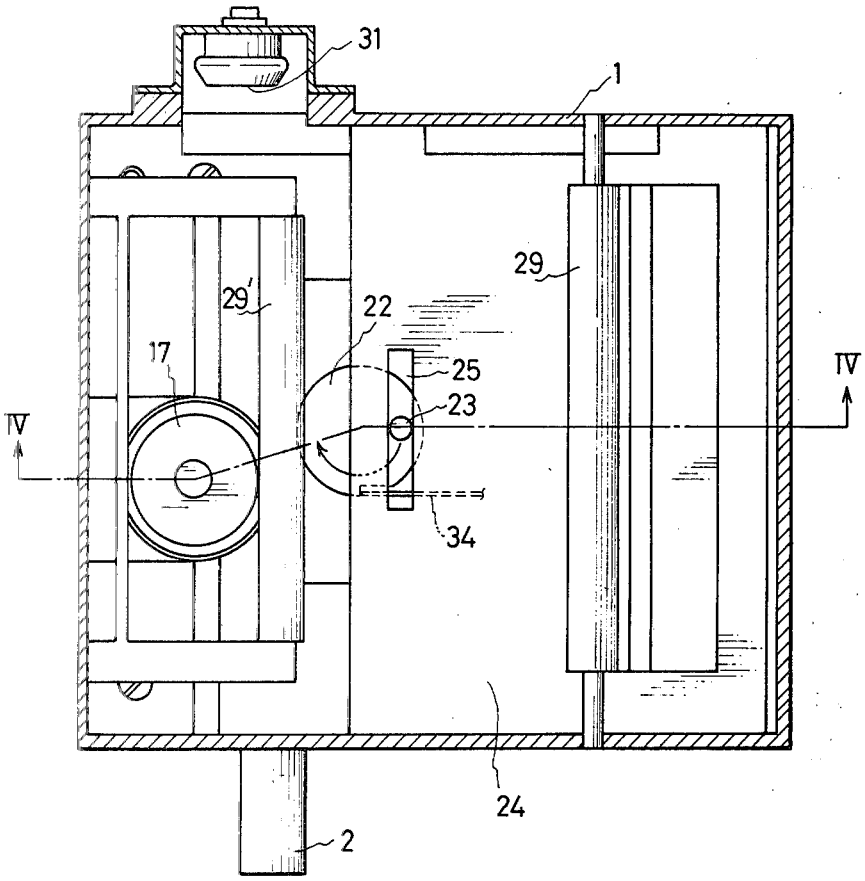
FIG. 3 is a schematic sectioned plan view with the rocking plate removed.

The cigarette feeding device of the present invention shall be explained with reference to the drawings. Reference numeral 1 denotes a case. A pushing lever 2 is projected at one end out of the case 1 and is engaged at the other end with a rocking lever 4 rocking with a shaft 3 as a fulcrum within the case 1. Pulleys 5 and 6 are fitted to the rocking end of the rocking lever 4. A spiral spring 7 is fixed at one end to a fixer 8 through one, for example, the pulley 5 of the pulleys 5 and 6 and is closely wound at the other end on an upper pulley 9 provided within the case 1. Further, a second spiral spring 12 is closely wound at the respective ends on a lower pulley 10 rotating simultaneously with the upper pulley 9 and a pulley 11 provided on the wall of the case. Further, a spiral spring 13 is fixed at one end to a third fixer 14 through the above mentioned pulley 6 and is closely wound at the other end on a pulley 15 provided on the wall of the case.

A gear 16 is attached to the above mentioned upper pulley 9 and lower pulley 10 and a rotary chuck 17 is provided above them. The upper pulley 9, lower pulley 10, gear 16 and rotary chuck 17 are secured so as to rotate simultaneously. An opposed gear 18 is engaged with the gear 16, has a ratchet wheel 19 formed integrally or fixed to it and is locked to a shaft 20 through a one-way clutch 21. A disk 22 is fixed to the shaft 20. A projection 23 is provided on this disk 22 and is loosely fitted in a groove 25 opened laterally in a horizontally reciprocatable conveying plate 24.

Feeding plates feeding cigarettes onto the conveying plate are provided above the conveying plate 24, are two rocking plates 26 and 27 spaced from each other and are supported by cylindrical tubes 29 and 29' in which shafts 28 and 28' are respectively loosely fitted intermediately between the two rocking plates 26 and 27 or near the rocking ends so as to rise in contact with the conveying plate 24 or conveyed objects.

Further, a bimetallic strip 30 fixed at one end and wound with a heating wire is locked at the other end to the above mentioned ratchet wheel 19. A heater 31 is arranged in the tangential direction parallel with the axis of the pushing lever to the above mentioned rotary chuck 17. A delivery port 32 is opened on the wall surface of the case opposed to this heater 31. A limit switch 33 passing electricity to the heating wire of the bimetallic strip 30 and the heater 31 is arranged so as to contact the above mentioned rocking lever 4.

The above mentioned rotary chuck 17 may be formed of such elastic material as rubber. It is convenient to make the gear 16 and the opposed gear 18 of the same number of teeth so as to make one rotation with the maximum rocking width of the rocking lever 4. Further, the disk 22 is provided with an incision and a pawl 34 engaging with this incision.

In the drawing, reference numeral 35 denotes an intermediate bottom within the case 1. On this intermediate bottom, the conveying plate 24 reciprocates and the rotary chuck 17 rotates. Reference numeral 36 denotes a stopper for the rocking lever 4 and 37 denotes a cigarette.

Figure 11A:
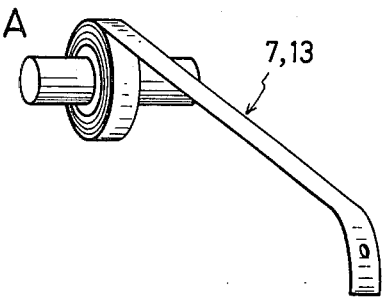
FIGS. 11 A and 11 B are perspective views of spiral springs.
Figure 11B:
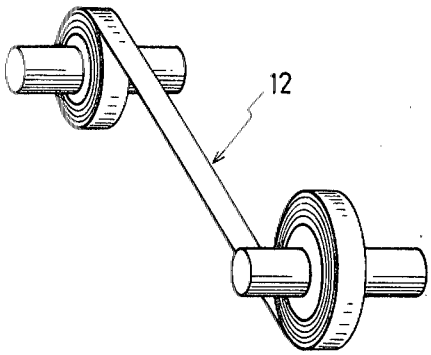

It is preferable to use entirely novel closely wound spiral springs for the above mentioned spiral springs 7, 12 and 13. The feature is a constant load. That is to say, their loads are always constant irrespective of the elongation and their spring constants are zero. As shown in FIG. 11 A, the above mentioned spring 7 or 13 is wound without being fixed at the inner end to the pulley so that the pulley may lightly rotate with the shaft as a center and when the spring is pulled out at the outer end, the pulley will rotate, the spring will be payed out and the force of the spring tending to return will be utilized. Further, as shown in FIG. 11 B, the spring 12 is fixed at the turned end to the pulley so that, when the spring is wound up on the pulley, the spring will tend to return to the original pulley.

Figure 6:
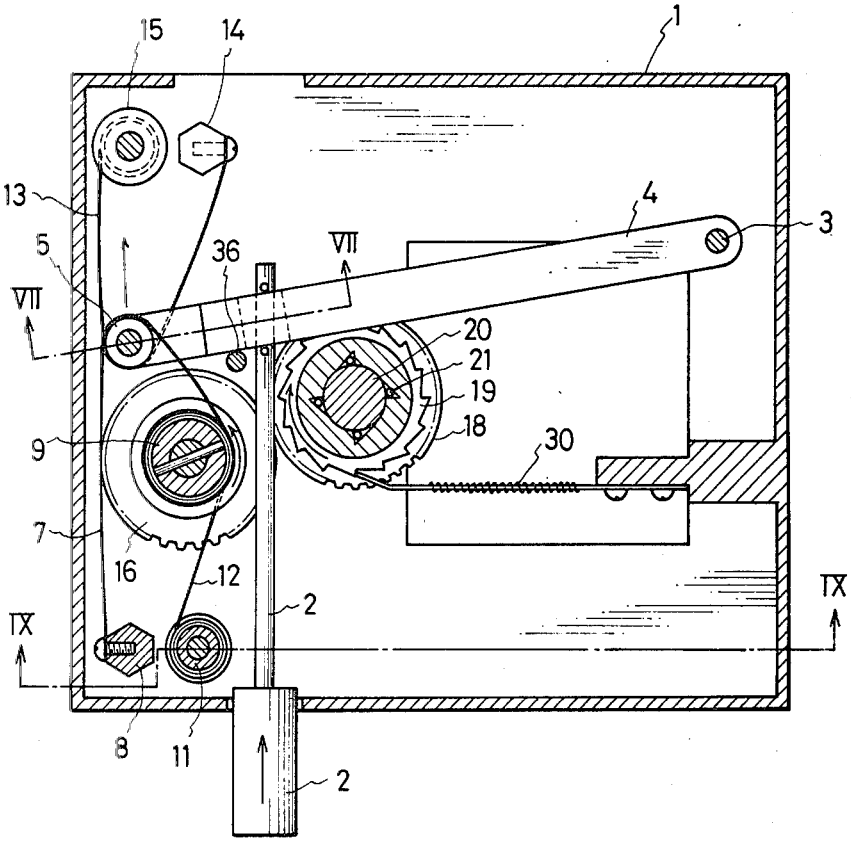
FIG. 6 is a sectioned view on line VI—VI in FIG. 4.
Figure 7:
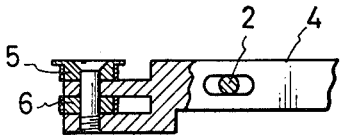
FIG. 7 is a partly sectioned view on line VII—VII in FIG. 6.
Figure 8:
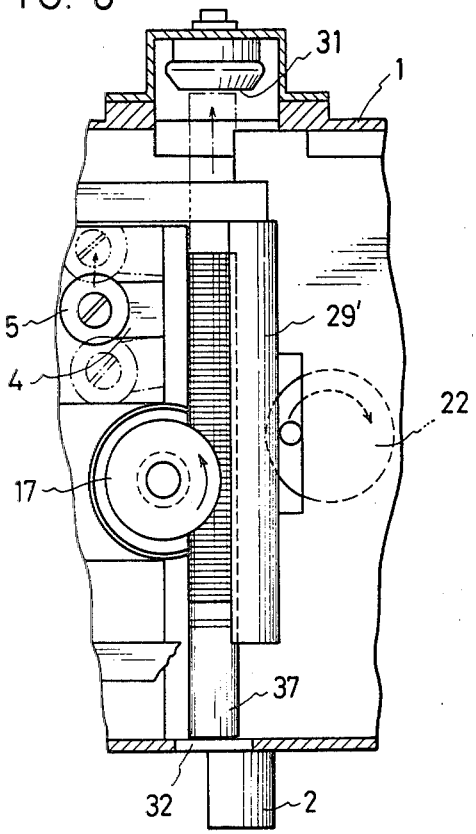
FIG. 8 is an operation explaining view.
Figure 9:
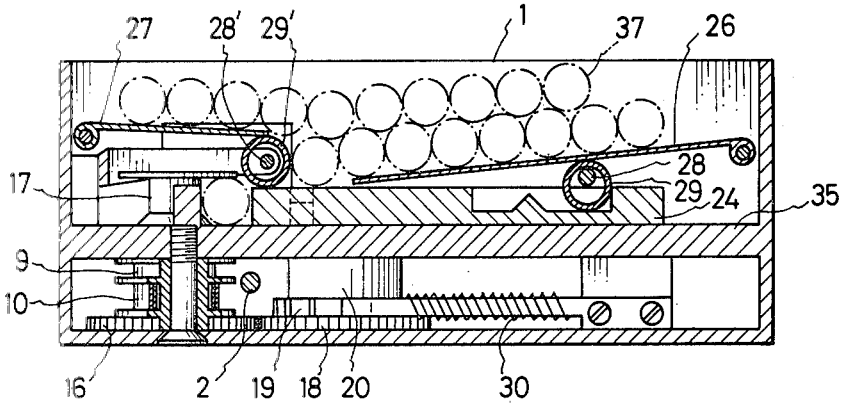
FIG. 9 is a sectioned view on line IX—IX in FIG. 6.

The operation of the preferred embodiment shall be explained in the following. When cigarettes are contained in the case from above and the projecting part of the pushing lever 2 is pushed (FIGS. 6 and 10), the rocking lever 4 will rock in the direction indicated by the arrow with the shaft 3 as a fulcrum. The first spiral spring 7 will be pulled by the rocking end of the rocking lever 4 and therefore the gear 16 will be rotated in the direction indicated by the arrow together with the upper pulley 9. At this time, the second spiral spring 12 wound on the pulley 11 will be wound on the lower pulley 10 from the pulley 11 and, at the same time, the opposed gear 18 engaging with the gear 16 and the ratchet wheel 19 will be also rotated. The shaft 20 will be also rotated together with the gear 18 and therefore the projection 23 will be also rotated together with the disk 22 so that the conveying plate 24 will move on the intermediate bottom 35 and will feed the cigarette 37 in front of it to the rotary chuck 17 through below the cylindrical tube 29' (FIGS. 8 and 9).

Figure 10:
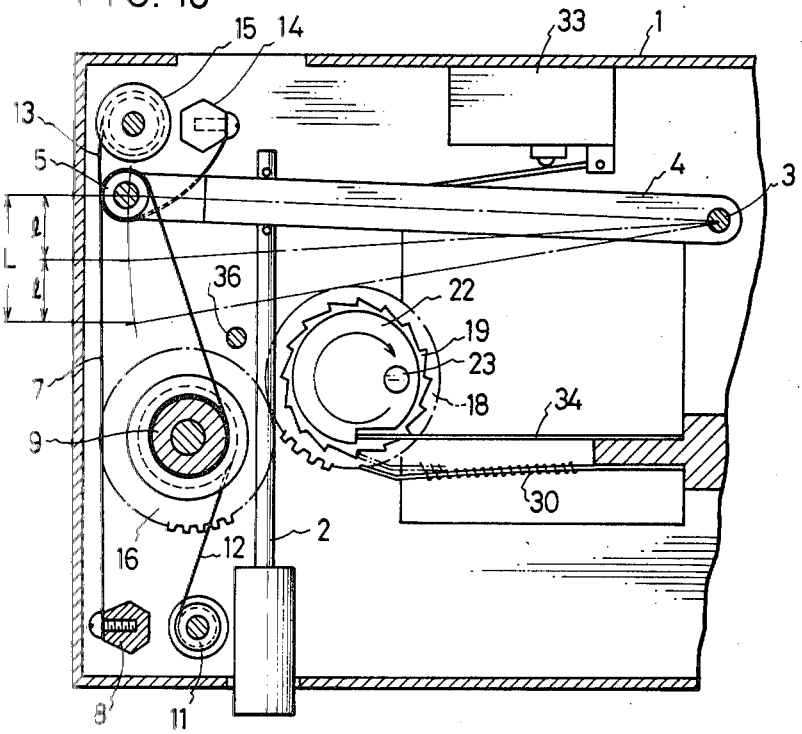
FIG. 10 is an operation explaining view.

The rocking end of the rocking lever 4 in the above operating state will be in the position advanced by an amount $l=\frac{1}{2}L$ shown in FIG. 10. When the rocking end is further advanced by an amount $2l=L$, the rocking lever 4 will push the limit switch 33 and will stop. At this time, the disk 22 will simultaneously continue to rotate to make one rotation and will stop in the position before the rotation and therefore the conveying plate 24 will also return and stop in the position before the advance. As the rotary chuck 17 will also rotate together with the gear 16, the cigarette will be pressed at the end against the heater 31.

At the time when the rocking lever 4 thus pushes the limit switch 33, the lower pulley 10 will also make one rotation and the spiral spring 12 will be wound up by the peripheral length of the lower pulley 10 and will accumulate the energy tending to return to the pulley 11 but, as the ratchet wheel 19 is locked by the bimetallic strip 30 as shown by the chain line in FIG. 10, the opposed gear 18, gear 16 and lower pulley 10 will be all locked so as not to be able to reversely rotate.

When the limit switch 33 is thus pressed, an electric current will flow to the heating wire of the bimetallic strip 30 and the heater 31. When the igniting time fitted to the cigarette elapses, as shown by the solid line in FIG. 10, the bimetallic strip 30 will deflect and will disengage with the ratchet wheel 19. At this time, the spiral spring 12 wound up on the lower pulley 10 and having accumulated the energy will be quickly wound back to the pulley 11, the gear 16 will rotate in the direction reverse to the direction indicated by the arrow in FIG. 6, at the same time, the rotary chuck 17 will also reversely rotate and the ignited cigarette will be taken out of the delivery port 32. Therefore, the upper pulley 9 will also rotate to wind up the spiral spring 7 and the rocking lever 4 will separate from the limit switch 33 and will be pulled to the original position to return to the stopper 36. At this time, the opposed gear 18 will also reversely rotate but the shaft 20 and disk 22 will not rotate with the one-way clutch 21 locked to the shaft 20. With the lapse of time, the bimetallic strip 30 will cool and will return to engage with the ratchet wheel 9.

Figure 4:
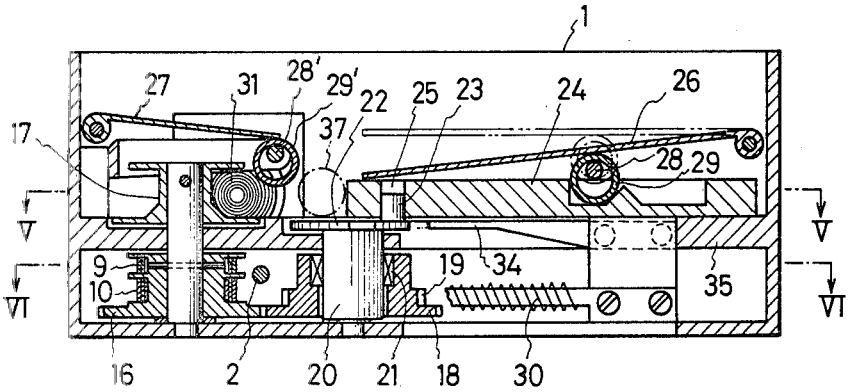
FIG. 4 is a sectioned view on line IV—IV in FIG. 3.
Figure 5:
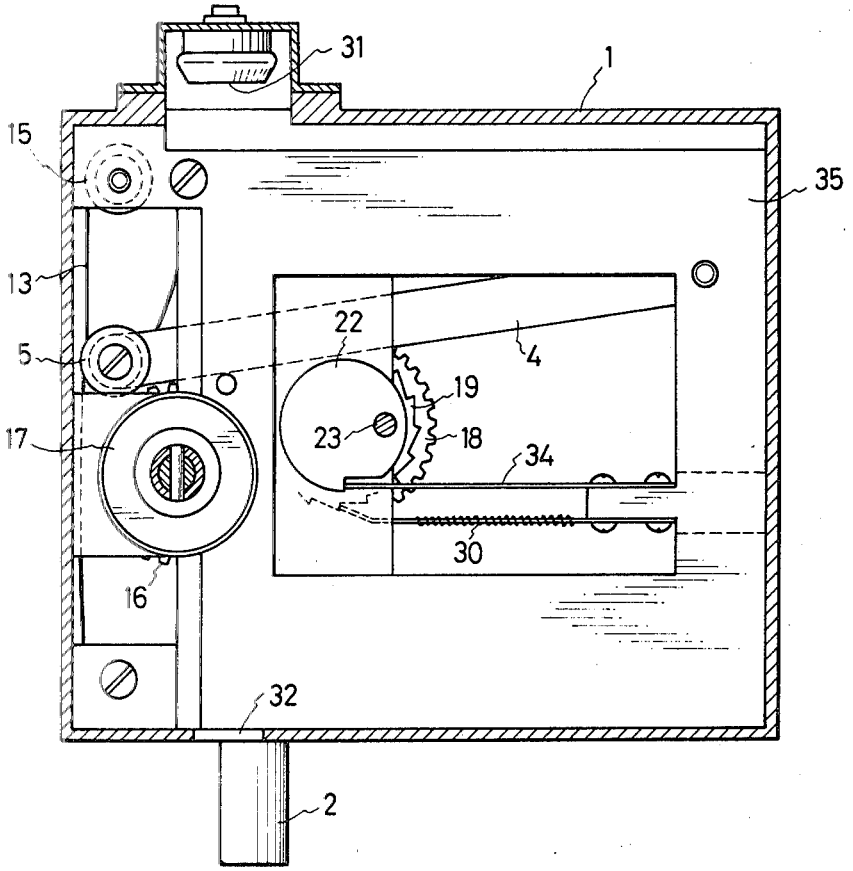
FIG. 5 is a sectioned view on line V—V in FIG. 4 with the conveying plate removed.

As in the above, when the push lever 2 is only pushed, the ignited cigarette will be automatically taken out. With the movement of the conveying plate 24 and cigarette, the rocking plates 26 and 27 will rock the cigarette through the cylindrical tube 29 and 29' to smoothly feed it to the position shown by the chain line in FIG. 4.

As described above, according to the present invention, by a very simple operation of only pressing the pushing lever, a cigarette can be automatically ignited and can be taken out as ready to be smoked as it is. It can be positively ignited and fed irrespective of its thickness and length.

UTILIZABILITY IN THE INDUSTRY

Therefore, according to the present invention, the aside looking operation accompanying the smoking operation which is one of the causes of accidents in the operation of cars and has been considered to be a problem expected to be foundamentally solved can be positively prevented and the present device can contribute to the safe operation.

What is claimed is:

1. A cigarette feeding device comprising a case a pushing lever mounted in the case for movement along its longitudinal axis and having a portion extending exteriorly of the case, a rocking lever having opposite ends, one end being pivotally mounted in the case, a portion of said rocking lever intermediate the two ends engaging said pushing lever, the other end bearing two pulleys, a rotary chuck mounted for rotation in said case having two pulley portions coaxial therewith, a first return spring having two ends and an intermediate portion, one end being fixed in the case, the other end being wound about one of the pulley portions of the rotary chuck, the intermediate portion passing around one of the two pulleys on the free end of the rocking lever, a second return spring having two ends, one end being wound around the other of the two pulley portions of the rotary chuck, a first fixed position rotatable pulley mounted in said case, the other end of the second return spring being wound about the first fixed pulley, a third return spring having two ends and an intermediate portion, one end being fixed in said case, the intermediate portion passing around the other of the two pulleys on the free end of the rocking lever, a second fixed position rotatable pulley mounted in said case, the other end of the third return spring being wound about the second fixed pulley, a first gear coaxially mounted on said rotary chuck, a shaft rotatably mounted in said case, a disk coaxially fixed to one longitudinal end of said shaft and having an upstanding eccentrically placed projection thereon, a second gear mounted for rotation on said shaft and engaging said first gear, a ratchet wheel coaxial with and fixed to said second gear, one-way clutch means interconnecting said second gear and said shaft for driving engagement of said second gear with said shaft in one direction only and permitting freewheeling of said second gear in an opposite direction, means for preventing said disk and said shaft from rotating in said opposite direction, bimetallic means fixed at one end to said case and engaging at an opposite end said ratchet wheel, a conveying plate horizontally slidably mounted in the case for reciprocation between a first position and a second position, said conveying plate having a groove therein parallel to the longitudinal axis of said pushing lever, said projection of said disk engaging said groove, at least one feeding plate having one end edge thereof pivotally mounted in said case and defining with said case a magazine for a plurality of cigarettes, means engagable with said at least one feeding plate and said conveying plate for pivoting said at least one feeding plate upon reciprocation of said conveying plate, heater means for igniting one end of a cigarette, said heater means being mounted in one side wall of the case, a delivery port in an opposite side wall of the case, said heater means and said port being aligned along a line which is tangent to said rotary chuck, and switch means mounted in the case engagable by said rocking lever for electrically connecting said heater means and said bimetallic means with a source of electrical power, whereby when said pushing lever is pressed, said rocking lever is pivoted unwinding and tensioning said first return spring from the rotary chuck thereby unwinding said second return spring from said first fixed pulley and winding it about the rotary chuck while winding the third return spring about the second fixed pulley; the unwinding of the first return spring rotating the rotary chuck and said first gear in a first direction thereby rotating the second gear, the ratchet wheel, the one-way clutch means, the shaft and the disk in said one direction; the rotation of the disk and the eccentric project thereof engaging the groove in the conveying plate causing the conveying plate to be moved horizontally from said first position to said second position; the movement of the conveying plate engaging the means for pivoting the at least one feeding plate causing one cigarette to move from the magazine to a position in front of the conveying plate when said conveying plate reaches said second position; further rotation of said disk and eccentric projection causing the conveying plate to reciprocate back to said first position pushing the cigarette to tangentially engage said rotary chuck; further pivoting of said rocking lever causing further rotation of the rotary chuck in said first direction pressing one end of the cigarette against the heater means, the further pivoting also causing the rocking lever to engage the switch means to pass electrical current to the heater means and the bimetallic means, the bimetallic means being in engagement with said ratchet wheel preventing rotation in said opposite direction until such time that the heater means has ignited the end of the cigarette whereupon the bimetallic means has also heated sufficiently to release the ratchet wheel; upon the release of the ratchet wheel, the tension of the second return spring rotating the rotary chuck and the first gear, in a direction opposite to said first direction and the second gear and the ratchet wheel in said opposite direction, the opposite rotation of the rotary chuck which tangentially engages the lit cigarette delivers the lit cigarette out of the delivery port; the pushing lever, the rocking lever, the first return spring, the second return spring, and the third return spring all returning to original position thereby disengaging the rocking lever from the switch means.

2. A cigarette feeding device according to claim 1 wherein said rotary chuck is formed of an elastic material.

3. A cigarette feeding device according to claim 1 or 2 wherein said first gear and second gear are made equal in the number of teeth.

4. A cigarette feeding device according to claim 3 wherein said first gear is so sized as to make one rotation at the time of the maximum pressing of said pushing lever.

5. A cigarette feeding device according to claim 4 wherein said return springs are constant load closely wound spiral springs.

6. A cigarette feeding device according to claim 3 wherein said return springs are constant load closely wound spiral springs.

7. A cigarette feeding device according to claim 1 wherein said feeding plates are rocking plates.

8. A cigarette feeding device according to claim 1, 2, or 7, wherein said return springs are constant load closely wound spiral springs.

9. A cigarette feeding device according to claims 1 or 2 wherein said gear is so sized as to make one rotation at the time of the maximum pressing of said pushing lever.

* * * * *